US010120340B2

(12) United States Patent
Vuille

(10) Patent No.: US 10,120,340 B2
(45) Date of Patent: Nov. 6, 2018

(54) WATCH COMPRISING A TRANSMISSION DEVICE BETWEEN A CONTROL MEMBER AND THE MOVEMENT

(71) Applicant: The Swatch Group Research and Development Ltd, Marin (CH)

(72) Inventor: Pierry Vuille, Les Emibois (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/723,535

(22) Filed: Oct. 3, 2017

(65) Prior Publication Data

US 2018/0095425 A1 Apr. 5, 2018

(30) Foreign Application Priority Data

Oct. 5, 2016 (EP) ..... 16192427

(51) Int. Cl.
*G04B 37/10* (2006.01)
*G04B 3/00* (2006.01)
(Continued)

(52) U.S. Cl.
CPC ..... *G04B 37/106* (2013.01); *G04B 3/008* (2013.01); *G04B 3/048* (2013.01); *G04C 3/005* (2013.01);
(Continued)

(58) Field of Classification Search
CPC ..... G04B 37/106; G04B 3/008; G04B 3/048; G04B 3/005; G04F 7/0861; G04F 7/08; G04F 7/0804; G04F 7/0842; G04F 7/0857
See application file for complete search history.

(56) References Cited

U.S. PATENT DOCUMENTS 4,364,674 A 12/1982 Tesch
5,224,077 A 6/1993 O'Brien
(Continued)

FOREIGN PATENT DOCUMENTS

CH 696 504 A5 7/2007
EP 1 553 468 A1 7/2005
(Continued)

OTHER PUBLICATIONS

Berner Horology Dictionary—fhs.swiss/berner/?l=en—printed Jun. 6, 2018.*
(Continued)

*Primary Examiner* — Sean Kayes
(74) *Attorney, Agent, or Firm* — Oblon, McClelland, Maier & Neustadt, L.L.P.

(57) ABSTRACT

The invention concerns a watch comprising a case having a middle part and inside which is housed a movement. The watch also includes a control member intended to be actuated by a user and an internal transmission device provided with an actuator, able to move, in response to actuation of the control member, between a rest position and an active position in which it actuates a mechanism of the movement. In an original manner, the transmission device includes a closed cavity filled with a fluid and a thrust means kinematically connected to the control member and arranged to displace the fluid inside the cavity, the displacement of fluid inside the cavity causing displacement of the actuator.

10 Claims, 3 Drawing Sheets

(51) Int. Cl.
*G04B 3/04* (2006.01)
*G04C 3/00* (2006.01)
*G04F 7/08* (2006.01)

(52) U.S. Cl.
CPC ..... *G04F 7/08* (2013.01); *G04F 7/0804* (2013.01); *G04F 7/0842* (2013.01); *G04F 7/0857* (2013.01); *G04F 7/0861* (2013.01)

(56) References Cited

U.S. PATENT DOCUMENTS 5,663,932 A * 9/1997 Weng ..... A44C 5/0007 2/312
6,236,624 B1 * 5/2001 Kriesel ..... G04F 1/06 368/65
7,963,692 B2 * 6/2011 Lynn ..... A61J 7/0472 368/327
8,995,237 B2 * 3/2015 Vouillamoz ..... G04B 1/265 368/223
2007/0153640 A1 7/2007 Saunier
2007/0289993 A1 * 12/2007 Nanda ..... B05B 11/30 222/39
2012/0147712 A1 * 6/2012 Lynn ..... G04F 1/00 368/89
2012/0147713 A1 * 6/2012 Vouillamoz ..... G04B 1/265 368/223
2012/0191051 A1 * 7/2012 Vouillamoz ..... G04B 1/265 604/264
2016/0133345 A1 * 5/2016 Vouillamoz ..... G04B 1/265 116/200
2016/0209810 A1 * 7/2016 Rohner ..... G04B 1/26
2017/0248917 A1 * 8/2017 Vouillamoz ..... G04B 1/265

FOREIGN PATENT DOCUMENTS

EP 1 710 635 A1 10/2006
WO WO 2016/110778 A1 7/2016

OTHER PUBLICATIONS

European Search Report dated Apr. 6, 2017 in European Application 16192427.9, filed on Oct. 5, 2016 (with English Translation of Categories of cited documents).

* cited by examiner

WATCH COMPRISING A TRANSMISSION DEVICE BETWEEN A CONTROL MEMBER AND THE MOVEMENT

This application claims priority from European Patent Application No. 16192427.9 filed on Oct. 5, 2016; the entire disclosure of which is incorporated herein by reference.

The present invention relates to the field of horology. It concerns a watch that includes a movement and that has a transmission device between an external control member and a mechanism of the movement.

In most watches, the mechanisms of the movement are placed facing the pushers that actuate them, such that the architecture of the movements and the arrangement of the external control members are directly linked. The difficulty in devising a movement and then adding additional functions to it is the cause of certain similarities in very many horological creations. Conventionally, the push buttons actuating a chronograph, for example, are very often located between and two and four o'clock on either side of the control stem. There is already known a watch wherein the control pushers are not locating facing the mechanisms that they actuate inside the movement, an example of which is found in EP Patent Application 1553468. This watch includes a complex transmission system composed of rods and levers mounted between the movement and the case middle which allows the two push buttons actuating the chronograph to be positioned on the opposite side to the control stem while still retaining a conventional movement. However, this type of mechanism has several drawbacks: it is complex to devise, expensive to manufacture, bulky, heavy and the additional friction that it causes increases the force required to actuate the control pushers.

It is also known that the pushers that actuate the watch mechanisms may show some stiffness which will be felt differently according to the user. One solution for making the pushers more comfortable to use without having to modify the movement consists in adding a lever acting on the pusher to the case exterior. This device makes it possible to reduce the force required to actuate the mechanism substantially in proportion to the increase in the travel of the control member. However, this type of arrangement has the drawbacks of changing the aesthetic appearance of the watch, increasing its dimensions and complicating manufacture.

It is an object of the present invention to overcome the aforecited drawbacks of the prior art by proposing a new type of control device for watches and to offer new aesthetic and technical possibilities to watch and movement designers.

To this end, the invention concerns a watch comprising a case having a middle part inside which is housed a movement. The watch also includes a control member intended to be actuated by a user and an internal transmission device provided with an actuator, able to move, in response to actuation of the control member, between a rest position and an active position in which it actuates a mechanism of the movement. In an original manner, the transmission device includes a closed cavity filled with a fluid and a thrust means kinematically connected to the control member and arranged to displace the fluid inside the cavity, the displacement of fluid inside the cavity causing displacement of the actuator.

Such a construction has the advantage of removing correlation between the position of the control member and that of the mechanism which it actuates inside the movement. This not only makes it possible to place the control members at the desired locations on the case according to exclusively aesthetic and ergonomic criteria, but also to design movements without being constrained by these same criteria.

Other features and advantages of the invention will appear upon reading the description of example embodiments, given by way of non-limiting illustration, with reference to the annexed drawings, in which.

Figure 1:
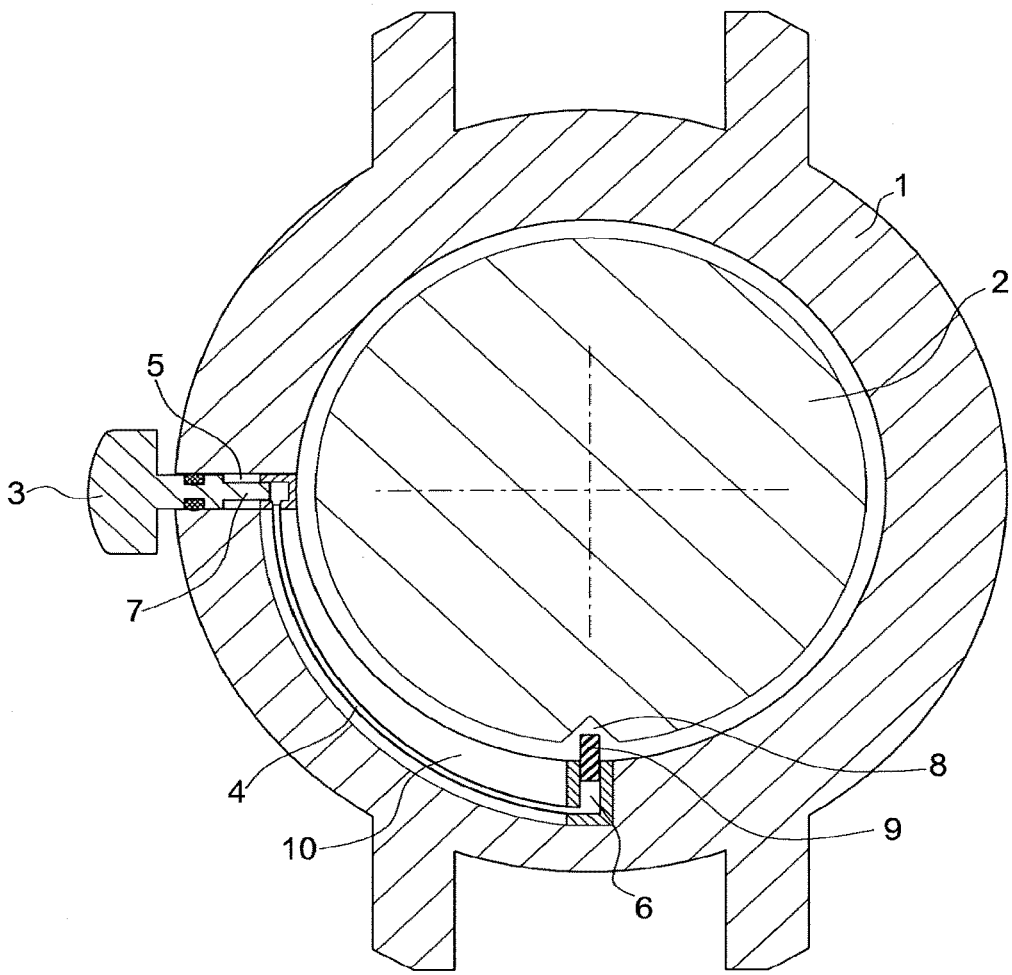
FIG. 1 represents a first embodiment of a watch according to the invention.

FIG. 1 represents a first embodiment of a watch according to the invention showing only details useful for understanding the technical problem. This watch includes a case whose middle part 1 is represented in cross-section in addition to a movement 2 located at the centre of case middle 1. A control member intended to be actuated by a user is shown in the form of a push button 3 extending outside case middle 1. An internal transmission device is housed inside case middle 1. This device includes a closed cavity filled with a preferably incompressible fluid. The cavity includes a hose or pipe 4 a first end of which leads to a control piston chamber 5 and whose second end leads to an actuator piston chamber 6. The transmission device further includes a thrust means able to displace the fluid inside the cavity. In the embodiment presented, the thrust means is a control piston 7 kinematically connected to pusher 3 and leading to the cavity in control piston chamber 5. Actuating pusher 3 causes the displacement of control piston 7 inside control chamber 5 and the displacement of fluid inside the cavity. The transmission device further includes an actuator disposed inside the case middle facing a mechanism 8 of the movement which the actuator is devised to actuate by moving from a rest position to an active position. The actuator includes an actuator piston 9 leading to actuator piston chamber 6 and arranged to move and actuate the mechanism as a result of the thrust of the fluid. Hose 4 is housed, for example, inside a groove 10 arranged in the inner face of case middle 1.

The transmission device is reversible, i.e. a return force exerted by mechanism 8 on the actuator, tending to return it to the rest position, causes actuator piston 9 to move, fluid to recede inside the cavity and pushes control piston 7 and pusher 3 back into their original position once the latter has been released. The transmission device may also comprise an additional return means, separate from the mechanism of the movement. This return means may take the form of a spring acting, for example, on the control member or on the actuator.

Figure 2:
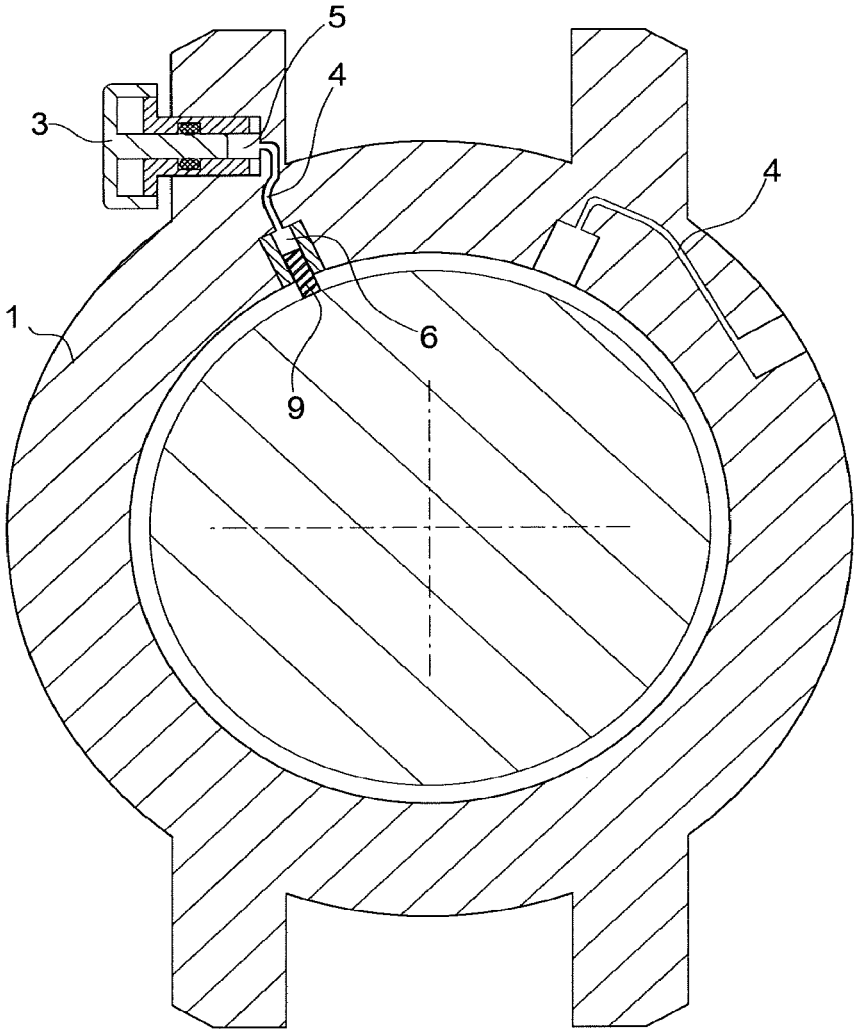
FIG. 2 represents a variant embodiment of the first embodiment.

According to a variant embodiment presented in FIG. 2, hose 4 connecting control piston chamber 5 to actuator piston chamber 6 may be formed directly inside case middle 1, either by a machining or etching or selective etching means, such as that described in EP Patent Application 2795410, which is incorporated herein by reference, or by a three-dimensional printing technique or by assembling two separately machined parts that form a pipe once assembled. The three-dimensional printing production method makes it possible to form, within the body of case middle 1, a complex network of pipes and housings intended to receive the actuators and control members. In this variant embodiment, the cavity is at least partially made within the body of case middle 1. This offers great ease and many possibilities of arrangement where the solution provided by the prior art was inflexible. Advantageously, the transmission of force by a fluid can be achieved with virtually no friction and with no need for lubrication.

Figure 3:
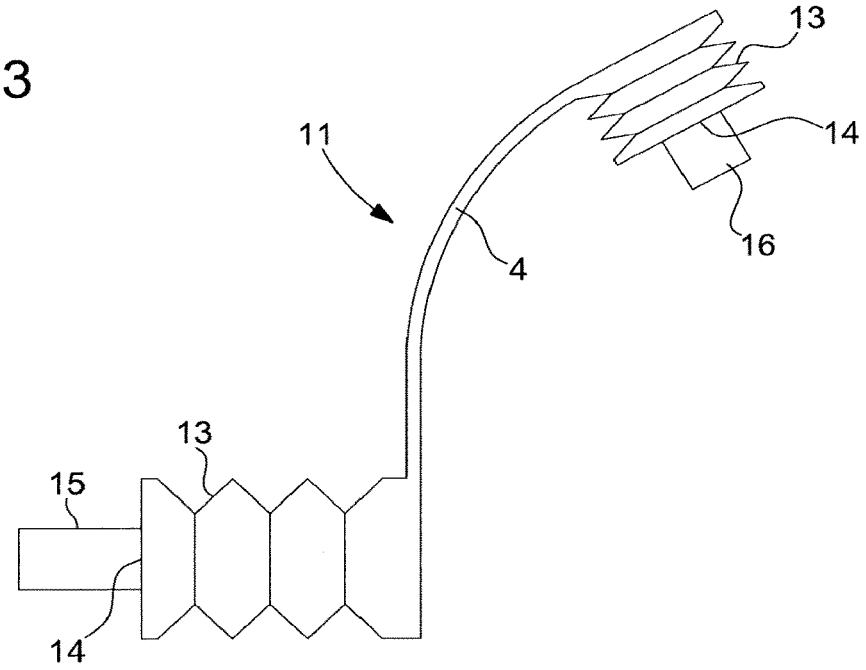
FIGS. 3 and 4 represent views of details of variants of a second embodiment.
Figure 4:
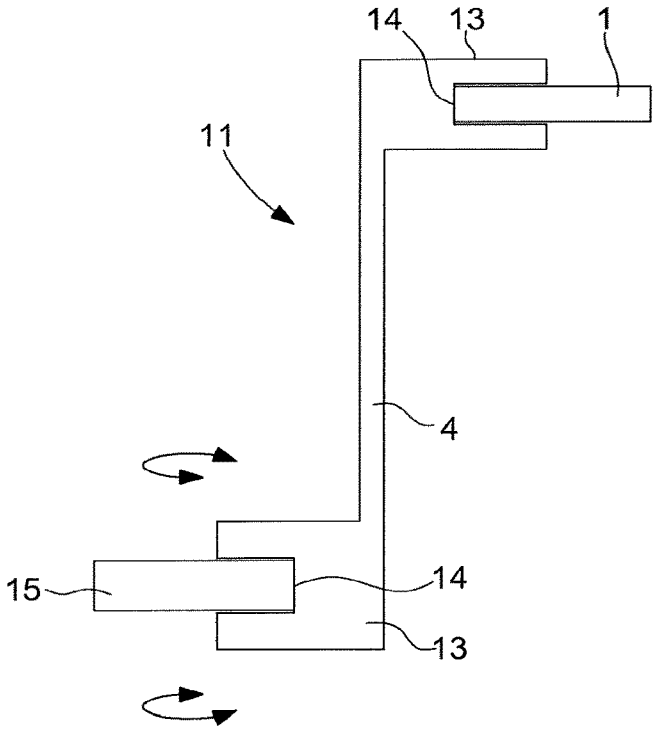

According to other variant embodiments of the invention presented in FIGS. 3 and 4, the transmission device includes a transmission module 11 filled with a preferably incompressible fluid. This module forms a closed cavity composed of a hose 4 connecting two deformable parts 13. In the example of FIG. 3, the deformable parts are bellows, in FIG. 4 they are pouches that can be turned over like a sock. The walls of deformable parts 13 are made of a flexible material such as, for example, silicone. The deformation of deformable parts 13 is reversible and can be obtained either by the displacement of fluid inside the cavity or by the displacement of a wall 14 of deformable part 13. The volume of fluid inside the cavity remains constant, so that the increase in volume of one deformable part 13 corresponds to the decrease in volume of the other deformable part 13. The deformable part can be deformed by an arbor 15 integral with the control member. An actuator arbor 16 actuates mechanism 8 of the movement. In this embodiment, the thrust means is a deformable part 13 of the cavity and the actuator also includes a deformable part 13 of the cavity. According to another configuration (not represented), one wall 14 of the cavity is accessible from outside the watch, flush with or slightly protruding therefrom. The user can directly exert a pressure on accessible wall 14 to displace the fluid inside the cavity and actuate the mechanism. In that case, cavity wall 14 directly forms the control member.

It is also possible to use metallic membranes that can be deformed under pressure from the control member, and which resume their place by spring effect once the stress is released.

Whether by means of a piston system moving inside the cavity or a deformable system, it is the displacement of a first cavity wall kinematically connected to the control member that causes the displacement of fluid inside the cavity. In the case of a piston, the moving wall is located directly on the piston. Likewise, the displacement of fluid inside the cavity causes the displacement of a second cavity wall kinematically connected to the actuator. Thus the first and second cavity walls are kinematically connected to one another and the control member is kinematically connected to the actuator. It is of course possible to combine all the types of thrust means or actuator with each other regardless of whether they have a piston or are deformable.

Advantageously compared to a direct transmission system in which a push button acts directly on the mechanism of the movement with a given travel and with a given force, the transmission device according to the invention makes it possible to vary the actuation force and travel independently of the mechanism. This is achieved simply by adapting the ratio between the fluid sections displaced at the thrust means and the actuator. In a transmission device using pistons, this means choosing a control piston 7 and an actuator piston 9 of different diameters. It is, for example, possible to reduce the force to be applied to the control member compared to that necessary to actuate the mechanism, by increasing its travel. Likewise, it is possible to obtain a longer actuator travel by increasing the force to be applied to the control member.

The solutions presented allow the movement mechanisms and the control members to be arranged independently. This gives movement designers great freedom, enabling them to envisage new architectures without having to worry about constraints relating to the aesthetic appearance of the watch or the ergonomics of its control members. In the embodiments presented, the actuators were placed in the case middle to actuate the movement mechanisms in a radial direction with reference to the centre of the movement. It is evident that the actuators could be disposed differently and exert a force in any direction. The actuators could also be placed at other locations on the case, on the case back or directly inside the movement as close as possible to the mechanisms that they actuate. The hose for transmitting the thrust force from the control member to the actuator could lead to the surface or to the interior of parts forming the case, or the movement, such as the case back, the container or the plate, or be directly formed in these components by rapid prototyping, machining or, for example, chemical etching means. The great freedom of positioning and of orienting the actuators simplifies the design of movements. Advantageously, the actuators' motions are linear and their travel can easily be adapted according to the requirements of the mechanism, which makes it possible to omit or reduce the size of some of the transmission levers. The space thereby freed can be used to incorporate complications or additional functions or to reduce the volume of the watch.

Alternatively, this also offers the designer new possibilities for arranging the control members on the watch. The pushers can thus be placed at unusual locations outside the plane of the movement, tilted, close to each other, on the top of the case, on the horns or the watchband or even on the clasp, etc. According to a variant of the invention, the bezel may form a discrete control member by rotating. To this end, a cam located on an inner face of the bezel may, depending on its angular position, actuate one or more thrust means acting as cam-follower. The ability to vary the actuation force of the control members also makes it possible to use, for the same mechanism, pushers of different size where the pressure felt by the user, i.e. the force applied divided by the surface area of the pusher, will be substantially identical. Alternatively, it is easy to adapt the stiffness of a control member to the requirements of a user by modifying the transmission device without having to modify the movement or the pushers.

Advantageously, the transmission device of the present invention makes it possible to achieve a non-linear function between the displacement of the control member and that of the actuator. This result can be obtained by using a deformable part 13 which, instead of being cylindrical as in FIGS. 3 and 4, has a variable section, such as for example a sphere, a cone or any other revolution shape of variable section. In the case where a mechanism has, in its actuation travel, a hard point, or, conversely, a portion of lower resistance, the use of suitable profiles can eliminate this type of disparity by smoothing the curve of the force felt at the control member. This particular arrangement makes it possible to improve the ergonomics of the control members and the quality perceived by the user.

Advantageously, the transmission device may include a regulating device able to adjust the mechanism's actuation threshold by the actuator in response to actuation of the control member. The regulating device may, for example, be devised to finely adjust the piston length of the control member or of the actuator. It may also be located in the cavity or the section of hose in which a deformable area could be arranged to be compressed to a greater or lesser extent by the displacement of a screw, a cam or any other equivalent device, which would have the effect of moving the actuator slightly in one direction or the other.

It is common for different functions to be actuated in a synchronized manner in a watch, for example the uncoupling and braking functions in a chronograph mechanism. According to a particular embodiment of the invention, the watch may comprise a plurality of actuators, disposed in parallel at two ends of the same cavity and able to move in a synchronized manner in response to the displacement of the same control member. Thus, the watch according to the invention provides the designer with a simple solution to overcome synchronization problems in movements.

There is therefore proposed a watch incorporating an original transmission device which offers many new possibilities for the design of movements and watches and which can also improve the ergonomics of control members.

What is claimed is:

1. A watch comprising a case having a middle part and inside which is housed a movement, the watch including a control member intended to be actuated by a user, the watch further comprising an internal transmission device provided with an actuator able to move, in response to actuation of the control member, between a rest position and an active position in which the actuator actuates a mechanism of the movement, wherein the transmission device includes a closed cavity filled with a fluid and a thrust means kinematically connected to the control member and arranged to displace the fluid inside the cavity, wherein the displacement of fluid inside the cavity causes displacement of the actuator, and wherein the thrust means is a control piston and in that the actuator includes an actuator piston.

2. The watch according to claim 1, wherein the watch comprises a plurality of actuators able to move in a synchronized manner in response to displacement of the control member.

3. The watch according to claim 1, wherein the watch includes a return means tending to return the actuator to its rest position.

4. The watch according to claim 1, wherein the control member is located outside a plane of the movement.

5. The watch according to claim 1, wherein the watch includes a bezel and wherein the bezel forms a control member.

6. The watch according to claim 1, wherein the watch includes a regulating device able to adjust an actuation threshold of the mechanism by the actuator in response to actuation of the control member.

7. The watch according to claim 1, wherein the cavity is at least partially made within the body of the case middle.

8. The watch according to claim 1, provided with a watchband, wherein the control member is placed on the watchband.

9. The watch according to claim 1, equipped with a watchband provided with a clasp, wherein the control member is placed on the watchband clasp.

10. The watch according to claim 1, wherein the fluid filling the cavity is incompressible.

* * * * *